US009370047B2

(12) United States Patent
Lee

(10) Patent No.: US 9,370,047 B2
(45) Date of Patent: Jun. 14, 2016

(54) RESISTIVE HEATING DEVICE FOR FABRICATION OF NANOSTRUCTURES

(71) Applicant: KOREA UNIVERSITY RESEARCH AND BUSINESS FOUNDATION, Seoul (KR)

(72) Inventor: Kwangyeol Lee, Namyangju-si (KR)

(73) Assignee: KOREA UNIVERSITY RESEARCH AND BUSINESS FOUNDATION, Seoul (KR)

( * ) Notice: Subject to any disclaimer, the term of this patent is extended or adjusted under 35 U.S.C. 154(b) by 0 days.

(21) Appl. No.: 14/054,676

(22) Filed: Oct. 15, 2013

(65) Prior Publication Data

US 2014/0042150 A1 Feb. 13, 2014

Related U.S. Application Data

(62) Division of application No. 12/549,012, filed on Aug. 27, 2009, now Pat. No. 8,592,732.

(51) Int. Cl.

| | |
|---|---|
| ***H05B 3/10*** | (2006.01) |
| ***H05B 3/03*** | (2006.01) |
| ***H05B 3/14*** | (2006.01) |

(52) U.S. Cl.

CPC ..... *H05B 3/03* (2013.01); *H05B 3/145* (2013.01); *H05B 2214/04* (2013.01); *Y10T 29/49083* (2015.01); *Y10T 29/49085* (2015.01); *Y10T 29/49087* (2015.01)

(58) Field of Classification Search

USPC ..... 29/611; 219/552

See application file for complete search history.

(56) References Cited

U.S. PATENT DOCUMENTS

| | | | | |
|---|---|---|---|---|
| 4,638,150 | A * | 1/1987 | Whitney | 219/543 |
| 6,541,539 | B1 | 4/2003 | Yang et al. | |
| 6,926,953 | B2 | 8/2005 | Nealey et al. | |
| 7,834,344 | B2 | 11/2010 | Mascolo et al. | |
| 2004/0228962 | A1 | 11/2004 | Liu et al. | |
| 2006/0173125 | A1 | 8/2006 | Lawson et al. | |
| 2006/0177952 | A1 | 8/2006 | Lambertini et al. | |
| 2008/0311347 | A1 | 12/2008 | Millward et al. | |
| 2009/0092803 | A1 | 4/2009 | Bita et al. | |
| 2009/0096348 | A1 | 4/2009 | Liu et al. | |
| 2009/0263628 | A1 | 10/2009 | Millward | |
| 2010/0294844 | A1 | 11/2010 | Loiret-Bernal et al. | |

FOREIGN PATENT DOCUMENTS

| | | |
|---|---|---|
| CN | 1692469 A | 11/2005 |
| CN | 1755938 A | 4/2006 |
| EP | 0562850 | 9/1993 |
| JP | H1079287 | 3/1998 |
| JP | H11251039 | 9/1999 |

(Continued)

OTHER PUBLICATIONS

Australian Patent Office, International Search Report and Written Opinion in associated PCT application No. PCT/KR2010/005758 mailed Dec. 6, 2010.

(Continued)

*Primary Examiner* — Lynne Gurley
*Assistant Examiner* — Vernon P Webb
(74) *Attorney, Agent, or Firm* — Workman Nydegger

(57) ABSTRACT

Apparatuses and techniques relating to a resistive heating device are provided.

22 Claims, 16 Drawing Sheets

(56) References Cited

FOREIGN PATENT DOCUMENTS

| | | |
|---|---|---|
| JP | 2003173858 | 6/2003 |
| JP | 2005002375 | 1/2005 |
| JP | 2005-190741 A | 7/2005 |
| JP | 2005-191214 A | 7/2005 |
| JP | 2007272223 | 10/2007 |
| JP | 2009094074 | 4/2009 |
| WO | 2009/134635 | 11/2009 |

OTHER PUBLICATIONS

Hongjie Dai, et al "Synthesis and characterization of carbide nanorods" Letters to Nature, vol. 375, Jun. 29, 1995 pp. 769-772.
Yuhei Hayamizu, et al "Integrated three-dimensional microelectromechanical devices from processable carbon nanotube wafers" Nature Nanotechnology, vol. 3, May 2008 pp. 289-294.
Stephen Y. Chou, et al "Improved nanofabrication through guided transient liquefaction" Nature Nanotechnology, vol. 3, May 2008, pp. 295-300.
Goki Eda, et al "Large-area ultrathin films of reduced graphene oxide as a transparent and flexible electronic material" Nature Nanotechnology, vol. 3, May 2008, pp. 270-274.
Guangyu Zhang, et al "Selective Etching of Metallic Carbon Nanotubes by Gas-Phase Reaction" Science, vol. 314, Nov. 10, 2006, pp. 974-977.
Dahl-Young Kahng, et al "A Stretchable Form of Single-Crystal Silicon for High-Performance Electronics on Rubber Substrates" Science, vol. 311, Jan. 13, 2006, pp. 208-212.
Melburne C. LeMieux, et al "Self-Sorted, Aligned Nanotube Networks for Thin-Film Transistors" Science, vol. 321, Jul. 4, 2008, pp. 101-104.
Dae-Hyeong Kim, et al "Stretchable and Foldable Silicon Integrated Circuits" Science, vol. 320, Apr. 25, 2008, pp. 507-511.
U.S. Appl. No. 12/549,012, Jun. 22, 2012, Office Action.
U.S. Appl. No. 12/549,012, Feb. 21, 2013, Office Action.
U.S. Appl. No. 12/549,012, Jun. 24, 2013, Notice of Allowance.
Ruiz, R., Et al., "Density Multiplication and Improved Lithography by Directed Block Copolymer Assembly," Science, vol. 321, pp. 936-939 (Aug. 15, 2008).
Chai, J., et al., "Assembly of aligned linear metallic patterns on silicon," Nature Nanotechnology, vol. 2, pp. 500-506 (Aug. 2007).
Bita, I., eta l., "Graphoepitaxy of Self-Assembled Block Copolymers on Two-Dimensional Periodic Patterned Templates," Science, vol. 321, No. 5891, pp. 939-943 (Aug. 15, 2008).
Adee, S., "Winner: The Ultimate Dielectric Is . . . Nothing," accessed at https://www.web.archive.org/web/20080906161257/http://www.spectrum.ieee.org/print/5811, accessed on Feb. 19, 2014, pp. 4.
International search report and Written Opinion for PCT/KR2010/004375, mailed on Aug. 27, 2010.
Cheng, J. Y., et al. "Templated Self-Assembly of Block Copolymers: Top-Down Helps Bottom-up," Advanced Materials, vol. 18, Issue 19, pp. 2505-2521 (Oct. 2006).
Li, HW. et al. "Ordered Block-Copolymer Assembly Using Nanoimprint Lithography," Nano Letters, vol. 4, Issue 9, pp. 1633-1636 (2004).
Yang, X. M., et al., "Guided Self-Assembly of Symmetric Diblock Copolymer Nanopaterened Films on Chemically Substrates," Macromolecules, vol. 33, Issue 26, pp. 9575-9582 (2000).

* cited by examiner

RESISTIVE HEATING DEVICE FOR FABRICATION OF NANOSTRUCTURES

CROSS REFERENCE TO RELATED APPLICATIONS

This application is a divisional under 35 U.S.C. §121 of U.S. patent application Ser. No. 12/549,012, filed on Aug. 27, 2009, now U.S. Pat. No. 8,592,732, the entirety of which is incorporated herein by reference.

BACKGROUND

Nanotechnology refers to a field involving manipulation and manufacture of materials and devices on the scale of nanometers (i.e., billionths of a meter). Structures the size of a few hundred nanometers or smaller (i.e., nanostructures) have garnered attention due to their potential in creating many new devices with wide-ranging applications, including optic, electronic, and mechanical applications. It has been envisioned that nanostructures may be used in manufacturing smaller, lighter, and/or stronger devices with desirable optical, electrical, and/or mechanical properties. There is current interest in controlling the properties and structure of materials at the nanoscale. Research has also been conducted to manipulate such materials to nanostructures and to assemble such nanostructures into more-complex devices.

SUMMARY

Techniques relating to a heating device are provided. In one embodiment, a heating device may include a substrate, at least one electrically-conductive elongated structure disposed on the substrate, the at least one electrically-conductive elongated structure including at least one resistive portion having a conductivity lower than that of the remaining portions of the at least one electrically-conductive elongated structure, and at least one heat-conductive column disposed on the at least one resistive portion of the at least one electrically-conductive elongated structure.

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION

Figure 1A:
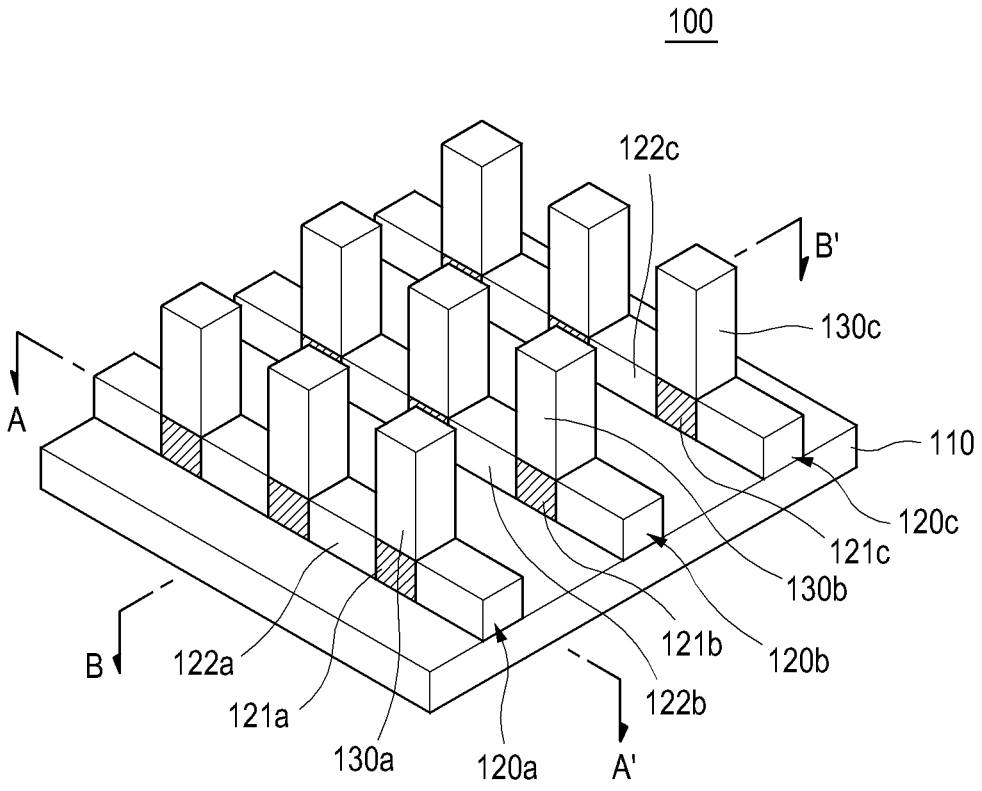
FIG. 1A shows a perspective view of an illustrative embodiment of a heating device.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented herein. It will be readily understood that the aspects of the present disclosure, as generally described herein, and illustrated in the Figures, can be arranged, substituted, combined, separated, and designed in a wide variety of different configurations, all of which are explicitly contemplated herein.

Small-scale structures, such as nanostructures, which may be suitable for creating many new devices with wide-ranging applications, are difficult to fabricate due to their small size. Techniques described in the present disclosure employ a novel heating device to locally apply heat upon discrete nano-sized region(s). Such local heating operation has vast applications in fabricating various types of nanostructures, such as nanodot arrays and nanowire arrays.

Figure 1B:
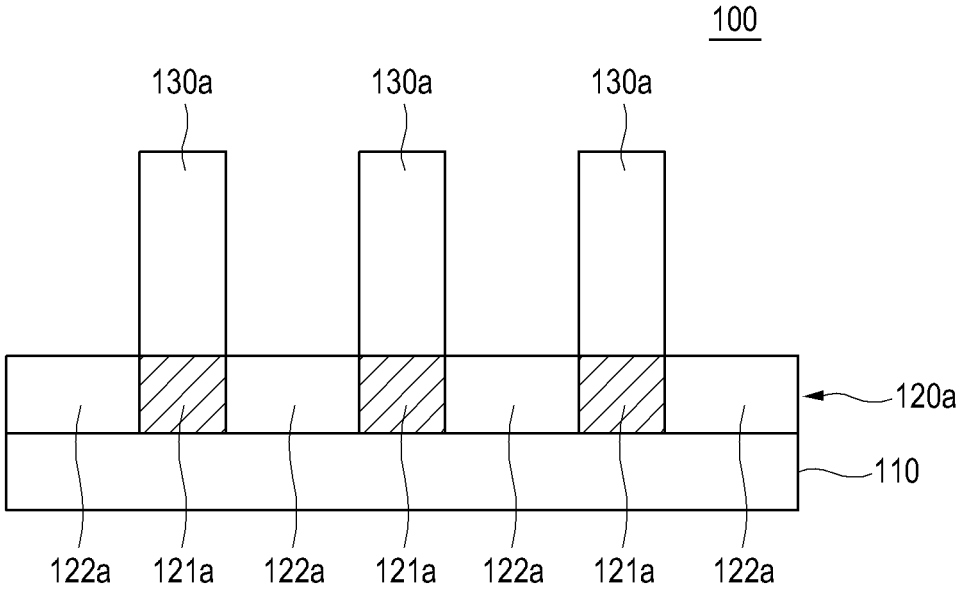
FIG. 1B shows a cross-sectional view of the illustrative embodiment of the heating device shown in FIG. 1A taken along line A-A'.
Figure 1C:
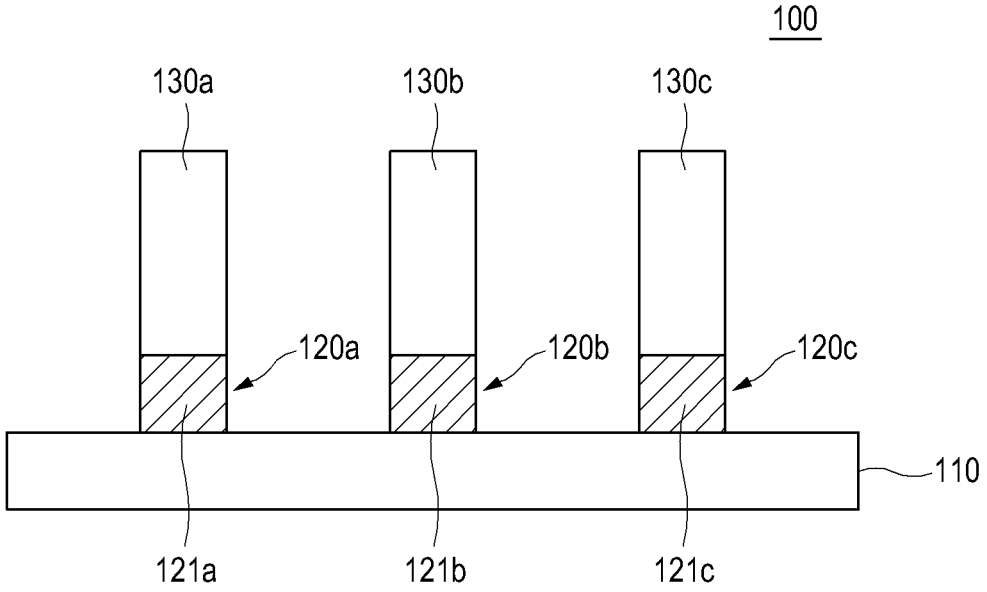
FIG. 1C shows a cross-sectional view of the illustrative embodiment of the heating device shown in FIG. 1A taken along line B-B'.

FIG. 1A shows a perspective view of an illustrative embodiment of a heating device. FIG. 1B shows a cross-sectional view of an illustrative embodiment of the heating device of FIG. 1A taken along line A-A'. FIG. 1C shows a cross-sectional view of an illustrative embodiment of the heating device of FIG. 1A taken along line B-B'. Referring to FIGS. 1A-1C, a heating device 100 may include a substrate 110, multiple electrically-conductive elongated structures 120*a*-120*c* (hereinafter collectively referred to as electrically-conductive elongated structures 120) located on substrate 110, and multiple heat-conductive columns 130*a*-130*c* (hereinafter collectively referred to as heat-conductive columns 130) respectively located on electrically-conductive elongated structures 120*a*-120*c*.

In one embodiment, substrate 110 may be fabricated from at least one material resistant to heat. By way of a non-limiting example, substrate 110 may be made of sapphire, glass, or semiconductor materials (e.g., silicon (Si), germanium (Ge), and gallium arsenide (GaAs)). In another embodiment, substrate 110 may be fabricated from a flexible material, such as an elastomeric material. Examples of such an elastomeric material include, but are not limited to, polydimethyl-siloxane (PDMS), poly-trimethyl-silyl-propyne (PTMSP), polyvinyl-trimethyl-silane (PVTMS), poly-urethanes/poly-ether-urethanes, natural rubber, ethene-propene (diene) rubbers (EP(D)M), and nitrile butadiene rubbers (NBR). Substrate 110 may be formed having any of a variety of shapes. In one embodiment, as shown in FIGS. 1A-1C, substrate 110 may be formed having a rectangular shape. In another embodiment, substrate 110 may be formed having a cylindrical shape with electrically-conductive elongated structures 120 disposed on its lateral surface. For example, substrate 110 may include a cylindrical core structure made of a substantially hard material (e.g., a semiconductor material) and at least one outer structure fabricated from a flexible material (e.g., an elastomeric material). The outer structure(s) may be configured to wrap around the cylindrical core structure so as to at least partially or completely cover the outer surface of the cylindrical core structure. In this embodiment, electrically-conductive elongated structures 120 may be disposed on the top surface(s) of the outer structure(s).

In one embodiment, each of electrically-conductive elongated structures 120 may include at least one resistive portion (e.g., resistive portions 121*a*-121*c* respectively in electrically-conductive elongated structures 120*a*-120*c*) having a conductivity lower than that of the remaining portions of the corresponding electrically-conductive elongated structure (e.g., remaining portions 122*a*-122*c* respectively in electrically-conductive elongated structures 120*a*-120*c*). Hereinafter, resistive portions 121*a*-121*c* and remaining portions 122*a*-122*c* are collectively referred to as resistive portions 121 and remaining portions 122, respectively. When any one of electrically-conductive elongated structures 120 is connected to an external electrical source (not shown) (e.g., a voltage source or a current source), an electrical current may flow through the corresponding electrically-conductive elongated structure. As the current flows therethrough, the resistive portions in the corresponding electrically-conductive elongated structure may produce heat due to the difference in the conductivity between the resistive portions and the remaining portions of the corresponding electrically-conductive elongated structure. This phenomenon is known as "resistive heating."

In one embodiment, resistive portions 121 may be made of metal carbide, such as titanium carbide and molybdenum carbide. Remaining portions 122 may be made of at least one material having conductivity higher than metal carbide. In one embodiment, remaining portions 122 may be made of carbon nano-tube (CNT) material. CNT may be a cylindrical material of regularly arranged carbon atoms having a diameter in the range of from about 1 nm to about 3 nm and having a height in the range of from about a few nanometers to about a few tens of micrometers. In another embodiment, remaining portions 122 may be made of graphene. Graphene is a planar sheet of $sp^2$-bonded carbon atoms that are densely packed in a honeycomb crystal lattice. Remaining portions 122 may include multiple stacked layers of graphene. For example, remaining portions 122 may include from a few to a few hundred stacked graphene layers.

In one embodiment, heat-conductive columns 130 may be respectively located on resistive portions 121 of electrically-conductive elongated structures 120. In this arrangement, each of heat-conductive columns 130 may conduct the heat produced by resistive portions 121 thereunder to the top portion of the corresponding heat-conductive column. This allows each of heat-conductive columns 130 to locally heat any material or structure that is in contact with or adjacent to itself. In one embodiment, heat-conductive columns 130 may be made of at least one material having a high thermal conductivity and may have an electrical conductivity lower than that of resistive portions 121. For example, heat-conductive columns 130 may be made of a heat-conductive material, such as metal (e.g., alumina), metal carbide, or metal oxide (e.g., indium tine oxide (ITO)).

In one embodiment, heating device 100 may further optionally include at least one insulating layer (not shown) on substrate 110. In one embodiment, the insulating layer(s) may be disposed between electrically-conductive elongated structures 120. In another embodiment, the insulating layer(s) may partially or fully cover electrically-conductive elongated structures 120. The insulating layer(s) may electrically separate each of electrically-conductive elongated structures 120, such that the heating of each of electrically-conductive elongated structures 120 may be individually controlled by at least one external electrical source.

In one embodiment, substrate 110 may have a side-length in the range from a few centimeters to a few hundred centimeters. In one embodiment, each of electrically-conductive elongated structures 120 may have a width in the range of from a few tens of nanometers to a few hundreds of nanometers and a length in the range of from a few micrometers to a few hundred centimeters. Electrically-conductive elongated structures 120 may be spaced-apart from each other by a distance in the range from about 50 nm to about 500 nm. It should be appreciated that, for the sake of simplicity, FIGS. 1A-1C shows an illustrative embodiment of three electrically-conductive elongated structures. Each of resistive portions 121 of electrically-conductive elongated structures 120 may be formed having a rectangular shape with its side-length measuring from about 50 nm to about 500 nm. In one embodiment, heat-conductive columns 130 may have a width measuring from about 50 nm to about 500 nm and may have a height measuring from a few tens of nanometers to a few hundred micrometers.

It should be appreciated that the structural and material configuration of heating device 100 and its components described in conjunction with FIGS. 1A-1C are indicative of a few of a variety of ways in which heating device 100 may be implemented. For example, while heating device 100, as shown in FIGS. 1A-1C, may include multiple electrically-conductive elongated structures 120, in some other embodiments, heating device 100 may have one electrically-conductive elongated structure. Further, while multiple heat-conductive columns 130 are disposed on each of electrically-conductive elongated structures 120, as shown in FIGS. 1A-1C, single heat-conductive column may be disposed on all or some of the electrically-conductive elongated structures. As shown in FIGS. 1A-1C, electrically-conductive elongated structures 120 may have the same length and may be disposed substantially parallel to each other. However, it should be appreciated that each of electrically-conductive elongated structures 120 may have different length(s) and may be arranged in any variety of manners. As described above, the heating of each of electrically-conductive elongated structures 120 may be individually controlled by connecting each of electrically-conductive elongated structures 120 with at least one external electrical source. The external electrical source(s) may selectively supply an electrical signal (e.g., a voltage signal) to the selected ones among electrically-conductive elongated structures 120, such that heat-conductive column(s) 130 located on the selected electrically-conductive elongated structure(s) 120 are heated, while the remaining heat-conductive column(s) 130 remain unheated. In some embodiments, heating device 100 may include electrically-conductive elongated structure(s) 120 with shorter length (and thus, smaller number of heat-conductive column(s) 130 located thereon), so as to enable the user of heating device 100 to minutely control selected heat-conductive column(s) 130 to be heated. Heating device 100 may be used to locally apply heat upon an array of discrete nano-sized regions. The overall pattern of such an array may depend on the manner of arranging electrically-conductive elongated structures 120 and heat-conductive column(s) 130 on substrate 110. Electrically-conductive elongated structures 120 and heat-conductive column(s) 130 may be arranged in a manner that substantially corresponds to the desired overall pattern of discrete nano-sized regions that are to be heated by heating device 100.

Figure 2:
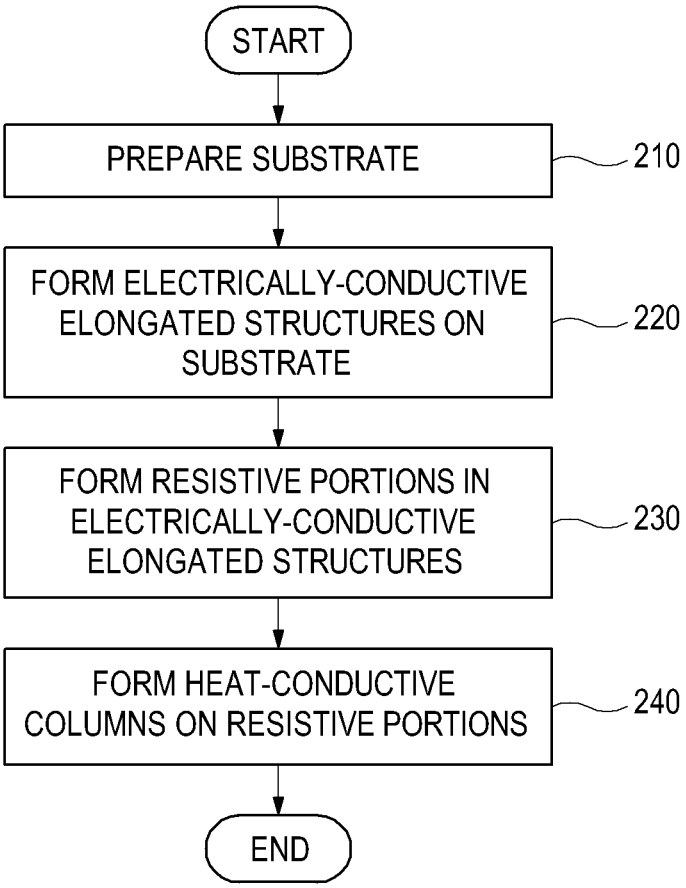
FIG. 2 shows an example flow diagram of an illustrative embodiment of a method for fabricating a heating device.
Figure 3A:
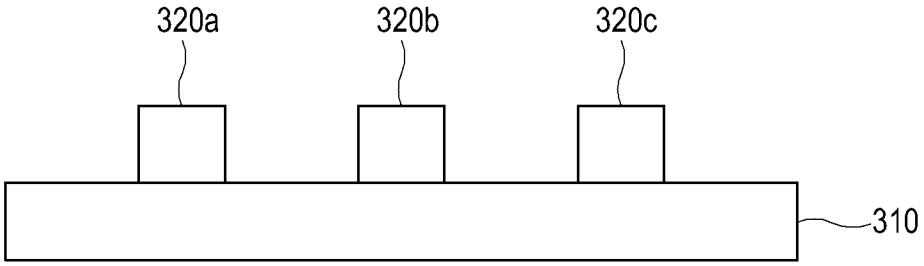
FIGS. 3A-3F are a series of diagrams illustrating some of the method shown in FIG. 2.
Figure 3B:
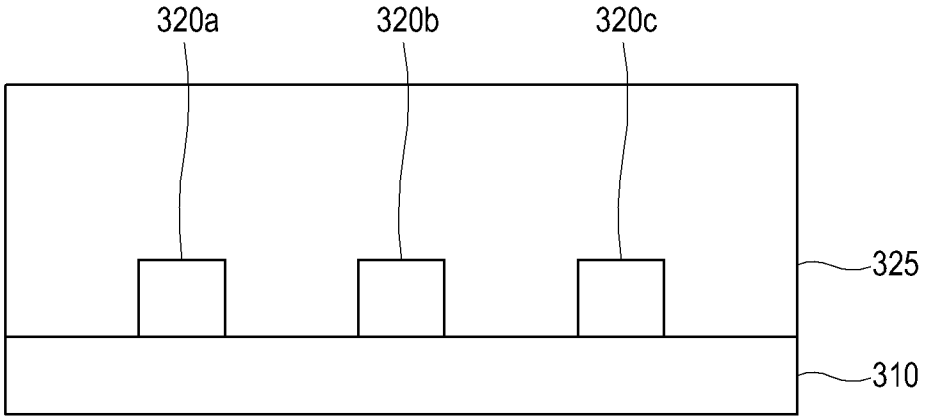
Figure 3C:
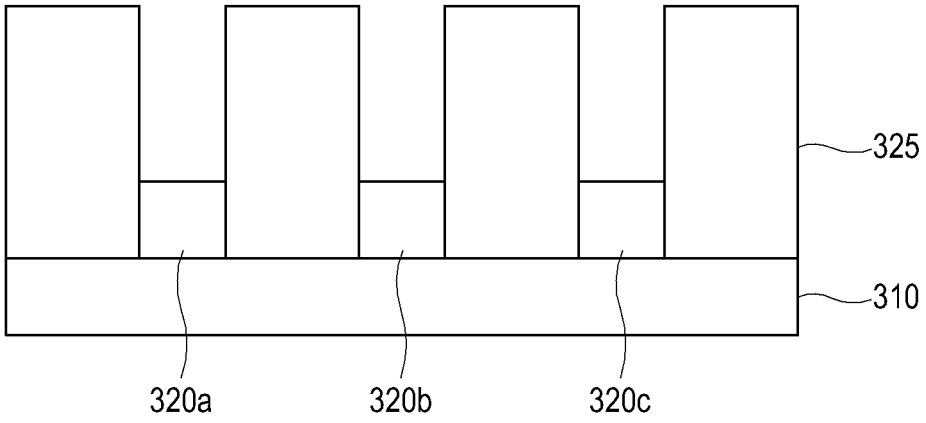
Figure 3D:
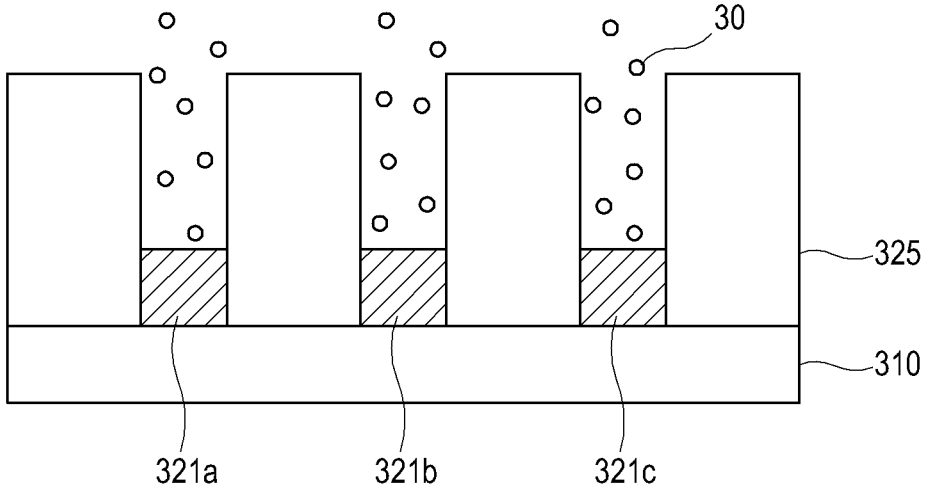
Figure 3E:
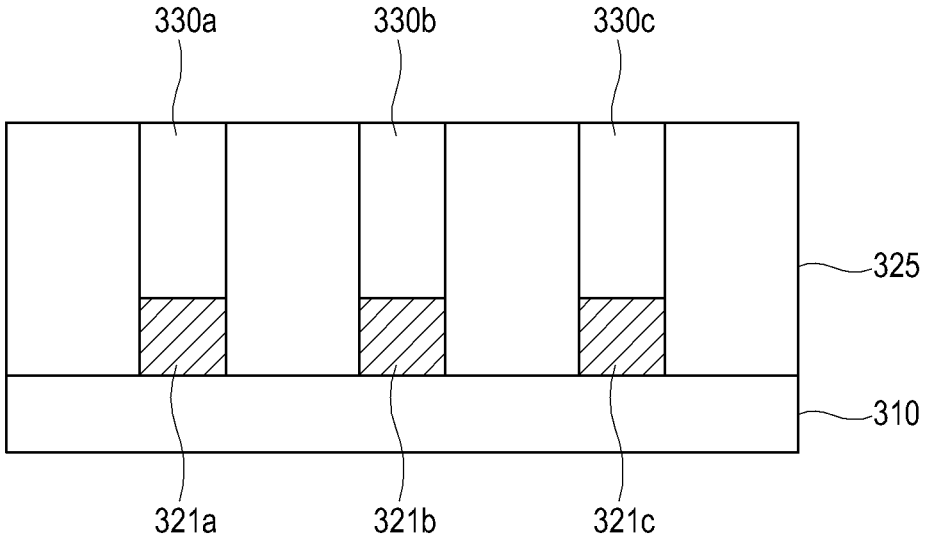
Figure 3F:
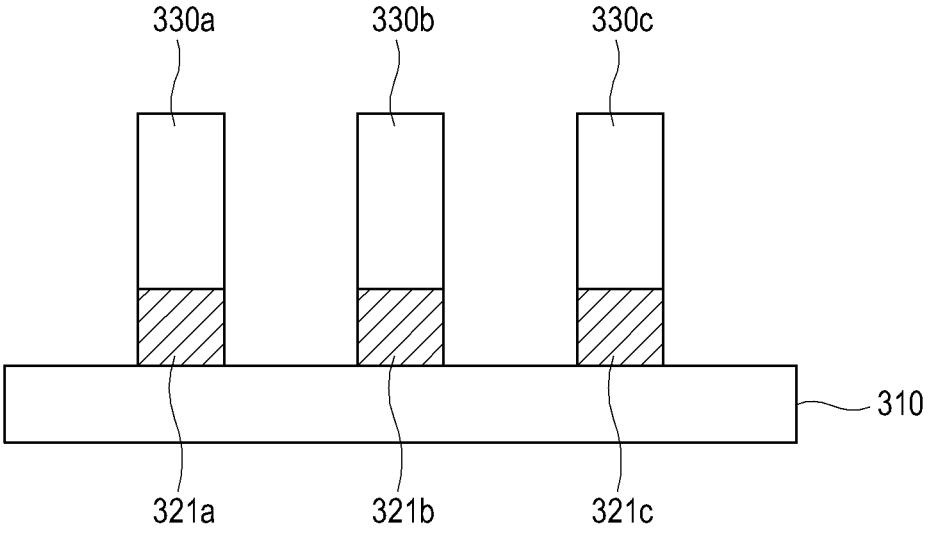

Referring to FIG. 2 and FIGS. 3A-3F, an example embodiment of a method for fabricating a heating device is explained hereafter. FIG. 2 shows an example flow diagram of an illustrative embodiment of a method for fabricating a heating device. FIGS. 3A-3F are a series of diagrams illustrating some of the method illustrated in FIG. 2. Particularly, FIG. 3A is a cross-sectional view of an illustrative embodiment of multiple electrically-conductive elongated structures formed on a substrate. FIG. 3B is a cross-sectional view of an illustrative embodiment of an insulating layer formed on the substrate and the multiple electrically-conductive elongated structures. FIG. 3C is a cross-sectional view of an illustrative embodiment of portions of the electrically-conductive elongated structures exposed after a removal process. FIG. 3D is a cross-sectional view of an illustrative embodiment of resistive portions formed by providing chemical reactants to the exposed portions of the electrically-conductive elongated structures. FIG. 3E is a cross-sectional view of an illustrative embodiment of heat-conductive columns respectively formed on the resistive portions by a deposition process. FIG. 3F is a cross-sectional view of an illustrative embodiment of the heat-conductive columns further exposed after the removal of the insulation layer.

A substrate 310 may be prepared (block 210). Substrate 310 may be prepared by using any of the materials described herein. At least one electrically-conductive elongated structure may be formed on substrate 310 (block 220). As depicted in FIG. 3A, multiple electrically-conductive elongated structures 320*a*-320*c* may be formed on substrate 310. Electrically-conductive elongated structure(s) 320*a*-320*c* may be formed by using one of various nano-fabrication techniques. Examples of such nano-fabrication techniques include, but are not limited to, (a) layer formation/etching techniques or (b) liquefaction techniques. The technical details relating to the nano-fabrication techniques of block 220 will be explained in more detail below with reference to FIGS. 4, 5A, 5B, 6, and 7A-7D.

At least one resistive portion may be formed in electrically-conductive elongated structures 320*a*-320*c* (block 230). In one embodiment, as depicted in FIG. 3B, an insulating layer 325 may be formed on substrate 310 to cover electrically-conductive elongated structures 320*a*-320*c* therewith. Insulating layer 325 may be made of an insulating material, such as silica, alumina, and silicon dioxide, and may be deposited on substrate 310 by employing known deposition techniques known in the art (e.g., chemical vapor deposition (CVD) technique). Further, insulating layer 325 may be etched by employing known masking and dry etching techniques known in the art (e.g., photolithography and plasma etching). The cross-section of the etched portions may be formed having a rectangular shape with the side-length measuring from about 50 nm to about 500 nm.

As depicted in FIG. 3C at least one portion of insulating layer 325 may be removed to expose at least one portion of electrically-conductive elongated structures 320*a*-320*c* thereunder.

At least one chemical reactant 30 may be provided to the exposed portions of electrically-conductive elongated structures 320*a*-320*c*. Chemical reactants 30 may chemically react with the exposed portions of electrically-conductive elongated structures 320*a*-320*c* and transform them into a resistive material that has a lower conductivity. Chemical reactants 30 may be provided under a prescribed temperature (e.g., temperature ranging from about 1100° C. to about 1500° C.), so as to facilitate the reaction between chemical reactants 30 and the exposed portions of electrically-conductive elongated structures 320*a*-320*c*. Accordingly, as depicted in FIG. 3D, resistive portions 321*a*-321*c* may be formed on the exposed portions of electrically-conductive elongated structures 320*a*-320*c*. Each of resistive portions 321*a*-321*c* may have a conductivity that is lower than that of the remaining portions of at least one electrically-conductive elongated structure 320*a*-320*c*.

Chemical reactants 30 may be made of a material such as a volatile metal or non-metal halide, a metal chloride, or a volatile metal or non-metal oxide. In the embodiments where electrically-conductive elongated structures 320*a*-320*c* are made of CNT or graphene, chemical reactants 30 may chemically react with the carbons in the CNT or graphene material and transform the carbons into carbides. The type of metal or non-metal elements in the above materials may vary depending on the type of resistive material to be obtained therefrom. For example, titanium chloride and molybdenum oxide may be used to form resistive portions 321*a*-321*c* made of titanium carbide and molybdenum carbide, respectively.

At least one heat-conductive column may be formed on resistive portions 321*a*-321*c* of at least one electrically-conductive elongated structure 320*a*-320*c* (block 230). In one embodiment, as depicted in FIG. 3E, a heat-conductive material may be deposited on the exposed portions of electrically-conductive elongated structures 320*a*-320*c* on which resistive portions 321*a*-321*c* are formed to form heat-conductive columns 330*a*-330*c* (block 240). Further, in another embodiment, as depicted in FIG. 3F, at least a portion of insulating layer 325 may be optionally removed to further expose at least a portion of heat-conductive columns 330*a*-330*c*. The heat-conductive materials may be deposited by using deposition techniques known in the art (e.g., CVD). Further, insulating layer 325 may be removed by masking and etching techniques known in the art (e.g., photolithography and plasma etching).

Figure 4:
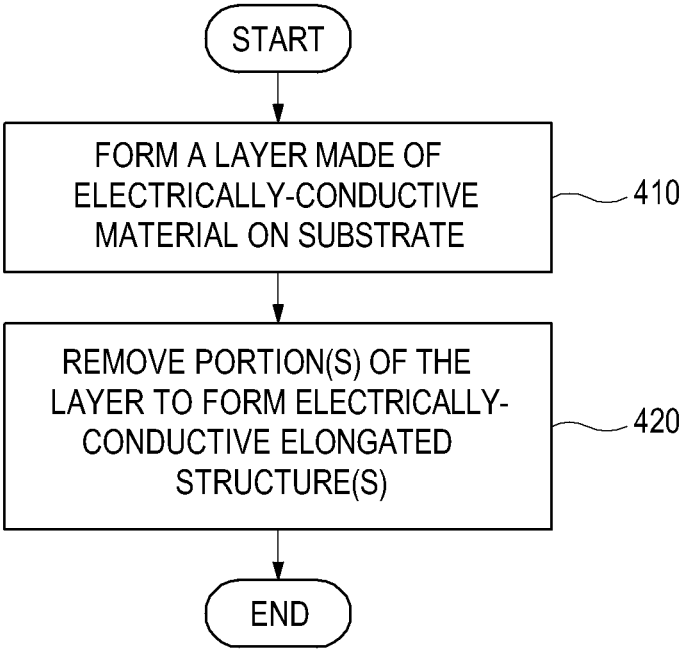
FIG. 4 shows a flow diagram of an illustrative embodiment of a method for fabricating electrically-conductive elongated structures.
Figure 5A:
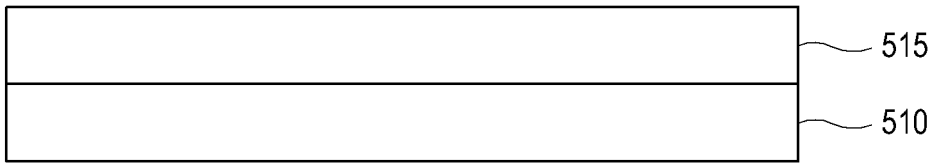
FIGS. 5A and 5B are a series of diagrams illustrating the method shown in FIG. 4.
Figure 5B:
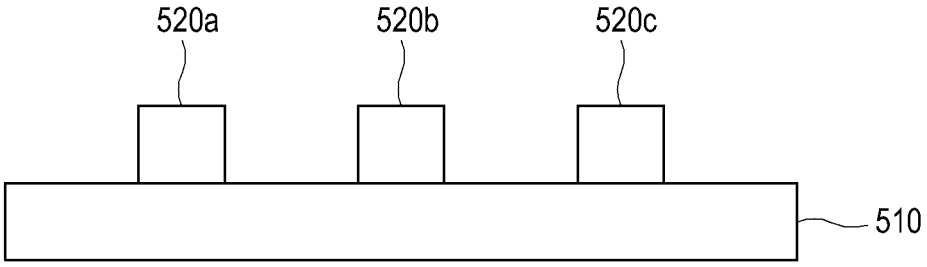

FIG. 4 shows a flow diagram of an illustrative embodiment method for fabricating electrically-conductive elongated structures. FIGS. 5A and 5B are a series of diagrams illustrating the method shown in FIG. 4. Particularly, FIG. 5A is a cross-sectional view of an illustrative embodiment of a layer made of an electrically-conductive material deposited on a substrate, and FIG. 5B is a schematic diagram illustrating the electrically-conductive elongated structure formed on the substrate. Referring to FIGS. 4 and 5A, a layer 515 made of an electrically-conductive material may be formed on a substrate 510 (block 410).

In one embodiment, the electrically-conductive material may be a CNT material. CNT materials may be deposited on substrate 510 by using a variety of techniques, two of which are explained below. In the first example, CNT materials may be deposited on substrate 510 by applying a CNT solution (i.e., a solution prepared by dispersing CNTs in a solvent, such as deionized water, alkane, or hexane) onto substrate 510 and then drying substrate 510. The CNT solution may be applied to substrate 510 by using a variety of techniques known in the art. Examples of such techniques include, but are not limited to, spin-coating and dip-coating. In one embodiment, the CNTs may be wrapped with surfactants or ligands for their effective dispersion into the solvent. An example of such an applicable surfactant includes, but is not limited to, 1-octadecylamine. In case where a solution dispersed with surfactant-wrapped CNTs is used, substrate 510 applied with such solution may be heated under an oxidizing atmosphere to remove the surfactants attached to the CNTs.

In the first example, prior to applying the CNT solution onto substrate 510, the surface of substrate 510 may be functionalized with at least one chemical material that may assist in selectively binding metallic CNTs in the CNT solution onto the surface of substrate 510. Examples of such chemical materials include, but are not limited to, phenyl-terminated silane. For example, substrate 510 may be coated with an oxide layer (e.g., $SiO_2$ layer) and then the oxide layer may be functionalized with the above chemical materials.

In the second example, first (a) an array of vertically-aligned CNT forest films of a few hundred micrometers in height is formed on substrate 510 by using water-assisted chemical vapor deposition (CVD) technique (so called "super growth" process). Thereafter, (b) substrate 510 with the CNT forest films formed thereon is drawn through a solution (e.g., an isopropyl alcohol (IPA) solution) to horizontally redirect the vertically-aligned CNTs, and then dried by introducing nitrogen gas. The above processes create a densely packed CNT layer, which can be used for subsequent photolithographic and etching processes performed thereon to form an electrically-conductive elongated structure(s) therefrom.

In another embodiment, the electrically-conductive material may be graphene. Graphene materials may be deposited on substrate 510 by using various techniques known in the art. For example, a few to a few hundred layers of graphene may be grown on a metal layer (which may be formed on a base structure) and the grown graphene layers may be transferred onto substrate 510.

Referring to FIGS. 4 and 5B, portion(s) of layer 515 on substrate 510 may be removed to form electrically-conductive elongated structure(s) 520*a*-520*c* (block 420) (hereinafter, collectively referred to as electrically-conductive elongated structures 520) on substrate 510 (block 520). The portions of layer 515 may be removed by employing masking and etching techniques known in the art (e.g., photolithography and plasma etching).

Figure 6:
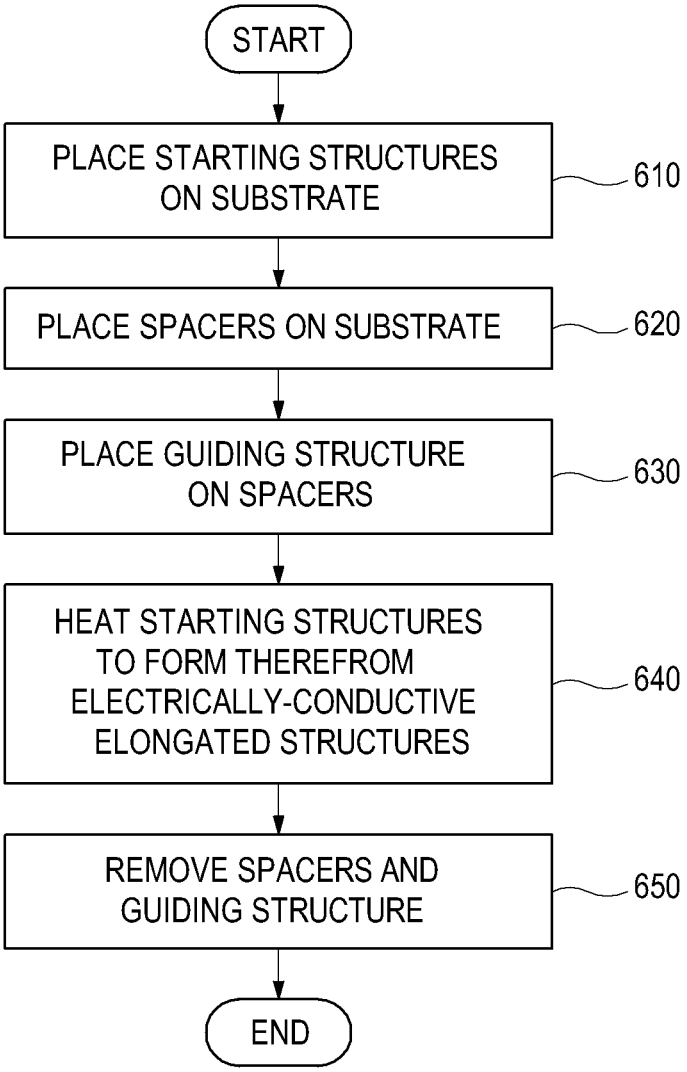
FIG. 6 shows a flow diagram of another illustrative embodiment of a method for fabricating electrically-conductive elongated structures.
Figure 7A:
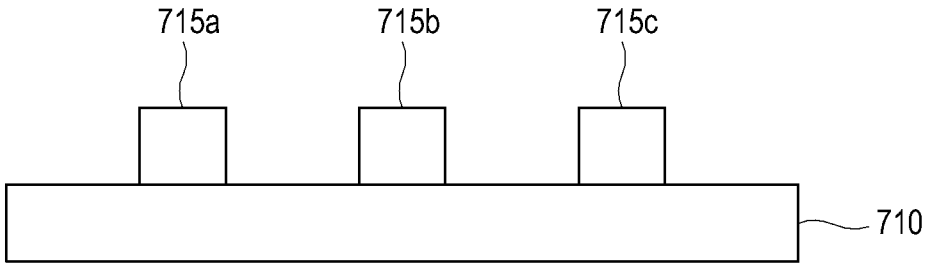
FIGS. 7A-7D are a series of diagrams illustrating the method shown in FIG. 6.
Figure 7B:
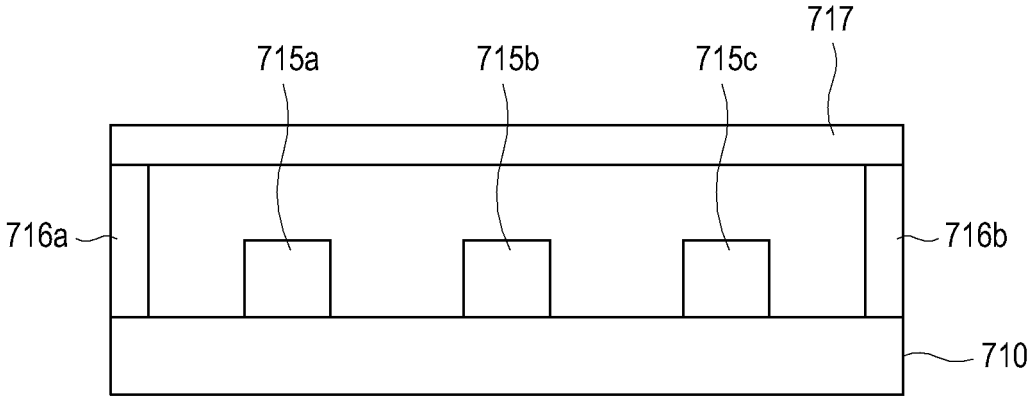
Figure 7C:
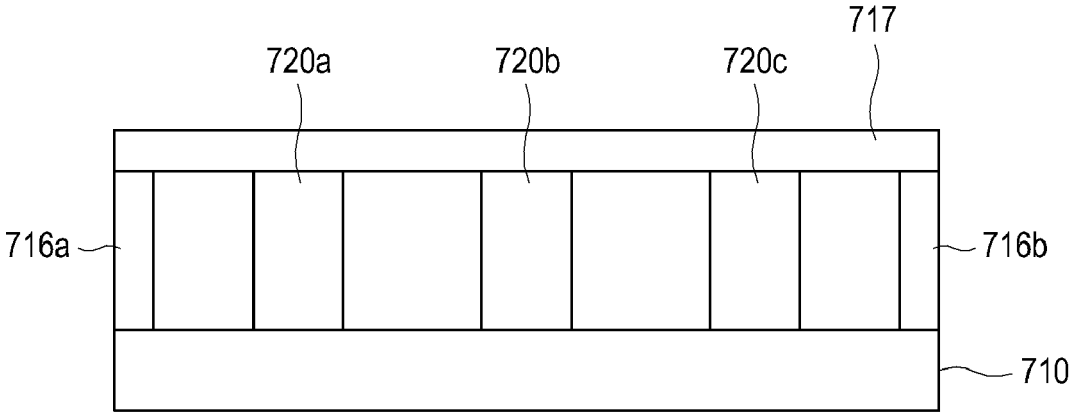
Figure 7D:
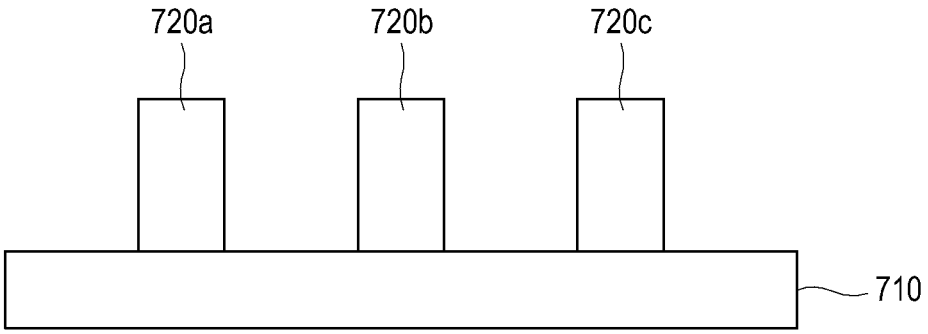

FIG. 6 shows a flow diagram of another illustrative embodiment of a method for fabricating electrically-conductive elongated structures. FIGS. 7A-7D are a series of diagrams illustrating the method shown in FIG. 6. In particular, FIG. 7A is a cross-sectional view of an illustrative embodiment of starting structures placed on a substrate. FIG. 7B is a cross-sectional view of an illustrative embodiment of spacers placed on the substrate and a guiding structure placed the spacers. FIG. 7C is a cross-sectional view of an illustrative embodiment of electrically-conductive elongated structures formed from the starting structures. FIG. 7D is a cross-sectional view of an illustrative embodiment of the substrate and the electrically-conductive elongated structures after the removal of the spacers and the guiding structure. In this embodiment, electrically-conductive elongated structures may be formed using a guided self-perfection by liquefaction (guided-SPEL) technique.

Referring to FIG. 6, as shown in FIG. 7A, starting structures 715*a*-715*c* (hereinafter collectively referred to as starting structures 715) may be prepared on a substrate 710 (block 610). As shown in FIG. 7B, spacers 716*a* and 716*b* (hereinafter collectively referred to as spacers 716) may be formed on both ends of substrate 710 (block 620). As shown in FIG. 7B, a guiding structure(s), such as a plate 717, may be formed on spacers 716 (block 630). As shown in FIG. 7C, starting structures 715 may be heated to form therefrom electrically-conductive elongated structures 720*a*-720*c* (hereinafter collectively referred to as electrically-conductive elongated structures 720) (block 640). In one embodiment, starting structures 715 may be heated by using a pulsed laser of a certain wavelength (e.g., a wavelength of from about 290 nm to 320 nm) with either a flood or masked beam, which selectively provides energy to melt the desired material while keeping the materials under and near starting structures 715 at a low temperature and in the solid phase. As starting structures 715 are heated, they become molten. The interaction between molten starting structures 715 and guiding structure 717 may cause molten starting structures 715 to rise up against the liquid surface tension to reach guiding structure 717 and may form substantially vertically-formed electrically-conductive elongated structures 720 thereby. As shown in FIG. 7D, spacers 716 and guiding structure 717 may be removed (block 650).

Figure 8:
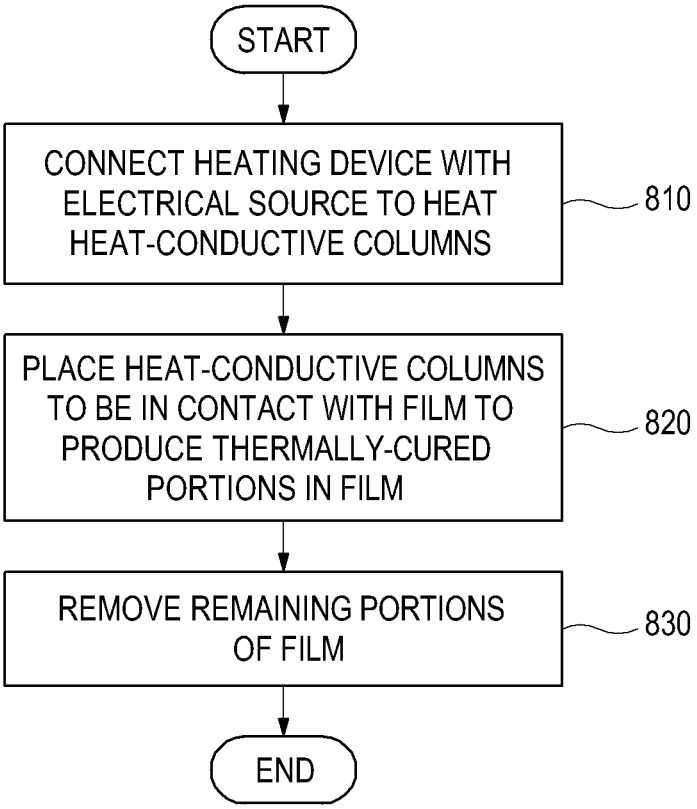
FIG. 8 shows an example flow diagram of an illustrative embodiment of a method for fabricating a nanodot array using a heating device.
Figure 9A:
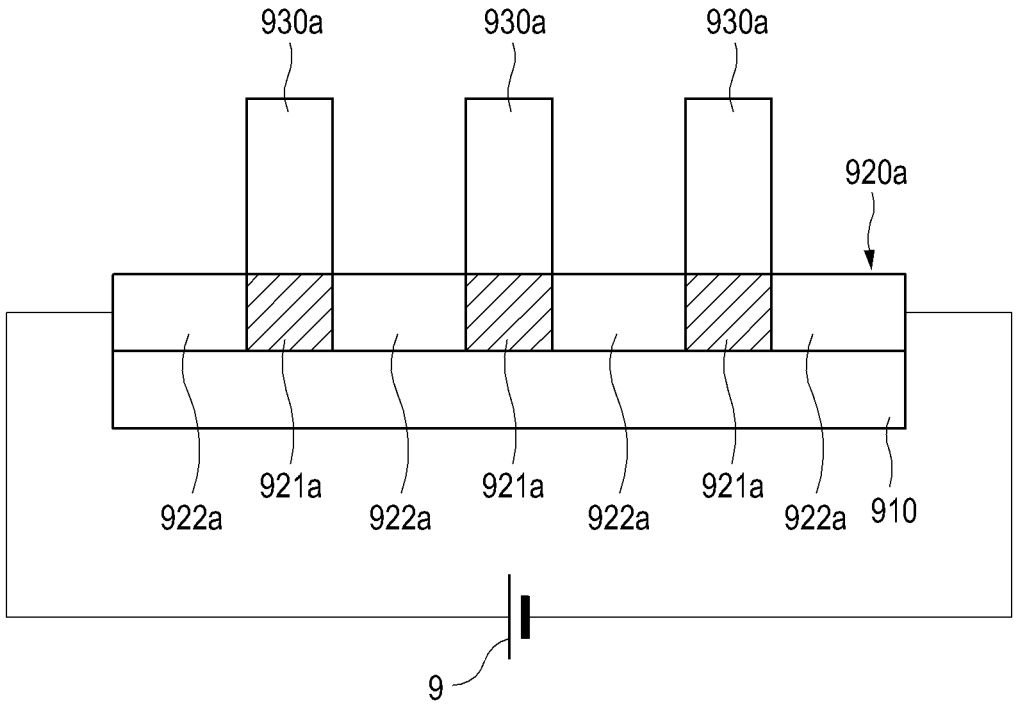
FIGS. 9A-9C are a series of diagrams illustrating some of the method illustrated in FIG. 8.
Figure 9B:
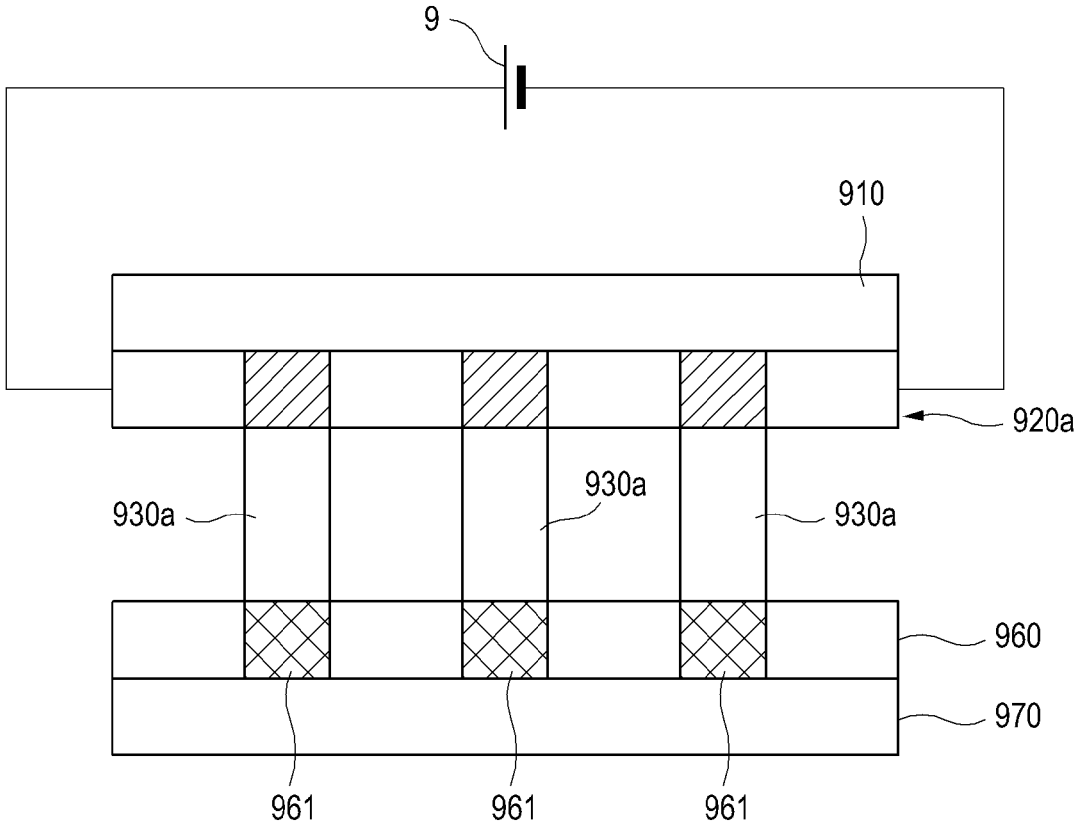
Figure 9C:
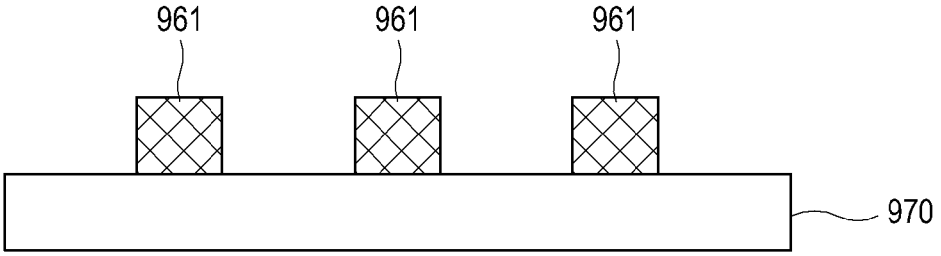

The heating device prepared in accordance with the present disclosure may be used in fabrication various types of nanostructures (e.g., a nanodot, a nanowire, a nanotube, a nanorod, a nanoribbon, a nanotetrapod, and the like) and an array thereof. FIG. 8 shows an example flow diagram of an illustrative embodiment of a method for fabricating a nanodot array using a heating device. FIGS. 9A-9C are a series of diagrams illustrating some of the method illustrated in FIG. 8. Particularly, FIG. 9A is a cross-sectional view of an illustrative embodiment of a heating device connected to an electrical source. FIG. 9B is a cross-sectional view of an illustrative embodiment of heat-conductive columns of heating device downwardly pressed onto a polymer film located on a substrate. FIG. 9C is a cross-sectional view of an illustrative embodiment of an array of thermally-cured portions or nanodots remaining on the substrate after uncured portions of the film are removed.

Referring to FIG. 8, a heating device 900 may be electrically connected with an electrical source 9 to heat at least some of the resistive portions of heating device 900, and consequently, the at least one heat-conductive column on the resistive portions (block 810). As shown in FIG. 9A, heating device 900 includes a substrate 910, at least one electrically-conductive elongated structure (including electrically-conductive elongated structure 920*a* having resistive portions 921*a* and remaining portions 922*a*), and at least one heat-conductive column (including heat-conductive columns 930*a* respectively disposed on resistive portions 921*a*).

In one embodiment, electrical source 9 may be electrically connected to the electrically-conductive elongated structure(s) (e.g., electrically-conductive elongated structure 920*a*) on which the heat-conductive columns that are to be heated (e.g., heat-conductive columns 930*a*) are located. While only one electrical source 9 is shown in FIG. 9A, more than one electrical source may be used. At least one of various switching mechanisms may be additionally employed to selectively electrically connect some of the electrically-conductive elongated structures of the heating device to the electrical source(s). This may enable one to selectively heat only the desired heat-conductive column(s) in the heating device. Such switching mechanisms are well known in the art and can be accomplished without the need of further explanation herein.

The heated heat-conductive columns may be placed in contact with a film, so as to produce at least one thermally-cured portion in the film (block 820 in FIG. 8). As shown in FIG. 9B, the heat-conductive columns (including heat-conductive columns 930*a*) of heating device 900 may be downwardly pressed onto a polymer film 960 located on a substrate 970. The heat-conductive columns (including heat-conductive columns 930*a*) locally heats portions of polymer film 960 up to a prescribed temperature (e.g., temperature ranging from about 200° C. to about 300° C.) to form thermally-cured portions (including thermally-cured portions 961). While heat-conductive columns 930*a* are described as being placed in contact with polymer film 960 in this embodiment, it should be appreciated that in other embodiments, heat-conductive columns 930*a* may be placed adjacent to or in proximity to polymer film 960.

Further, depending on the shape of the heating device, the heating device may be pressed onto the film using any of a variety of ways. While heating device 900 shown in FIG. 9B is of a rectangular shape, in other embodiments, the heating device may have a cylindrical shape with heat-conductive columns formed on the lateral portions of the heating device (i.e., a heat roller). In such embodiments, the heating device may be continuously rolled on a large planar film to sequentially form a series of thermally-cured portions therein.

The remaining portions of the film may be removed to form an array of nanodots (the nanodots respectively corresponding to the thermally-cured portions in the film) (block 830 in FIG. 8). The remaining portions (i.e., the uncured portions) of the film may be removed in a manner that is conventionally known in the art. For example, a solvent may be applied to the film so that the solvent may dissolve or disperse the uncured portions of the film. For example, as shown in FIG. 9C, an array of thermally-cured portions or nanodots 961 remains on substrate 970 after such removal operation is performed.

Figure 10:
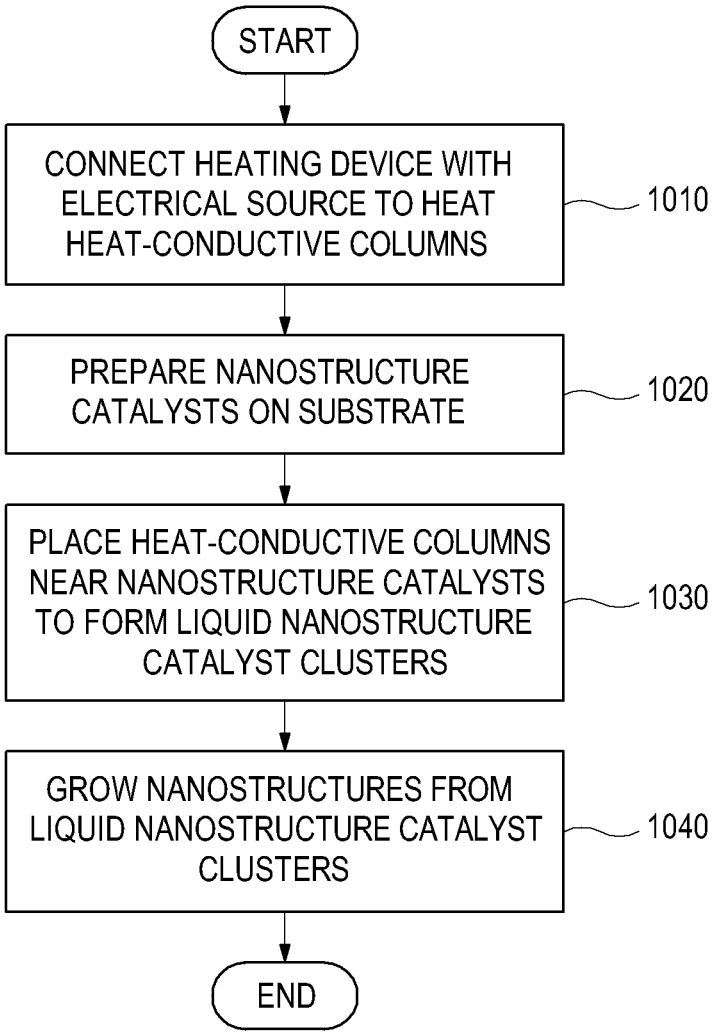
FIG. 10 shows an example flow diagram of an illustrative embodiment of a method for fabricating a nanowire array using a heating device.
Figure 11A:
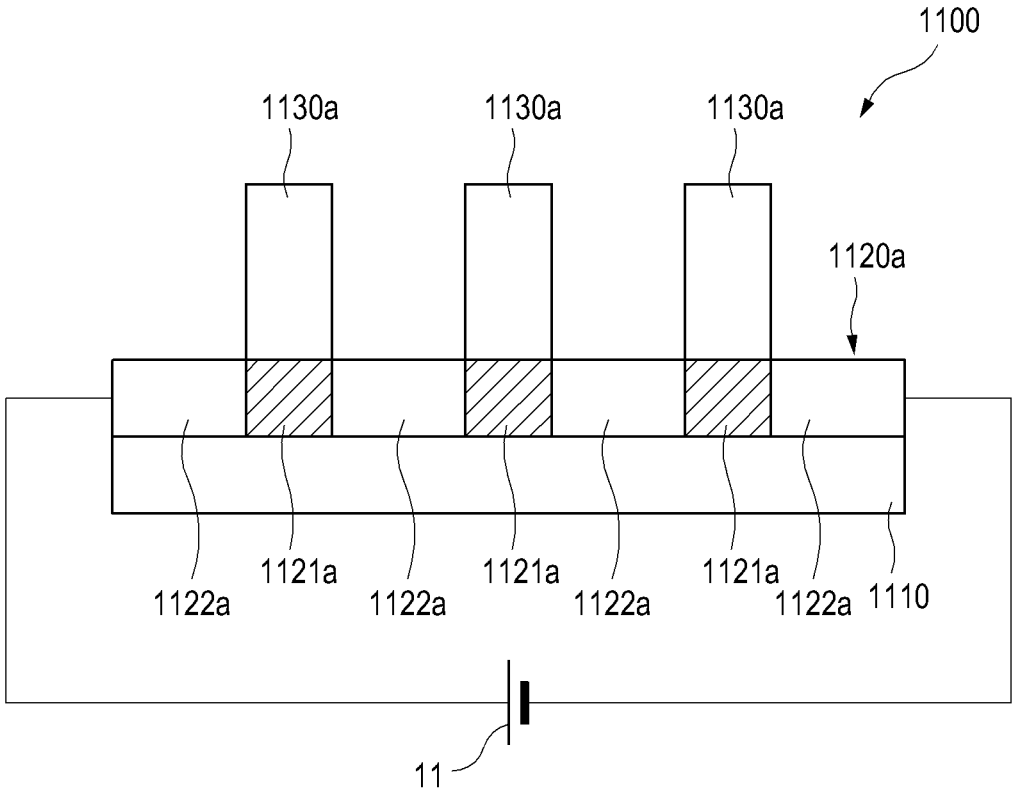
FIGS. 11A-11E are a series of diagrams illustrating some of the method illustrated in FIG. 10.
Figure 11B:
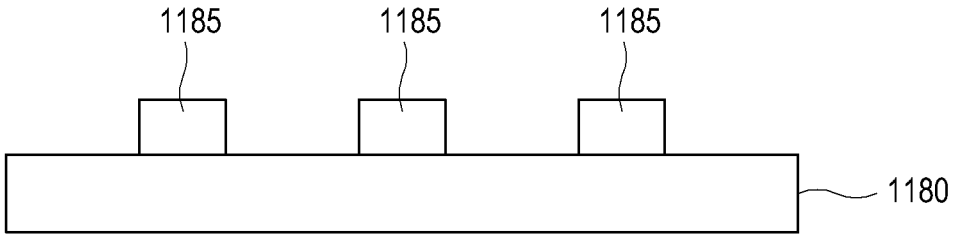
Figure 11C:
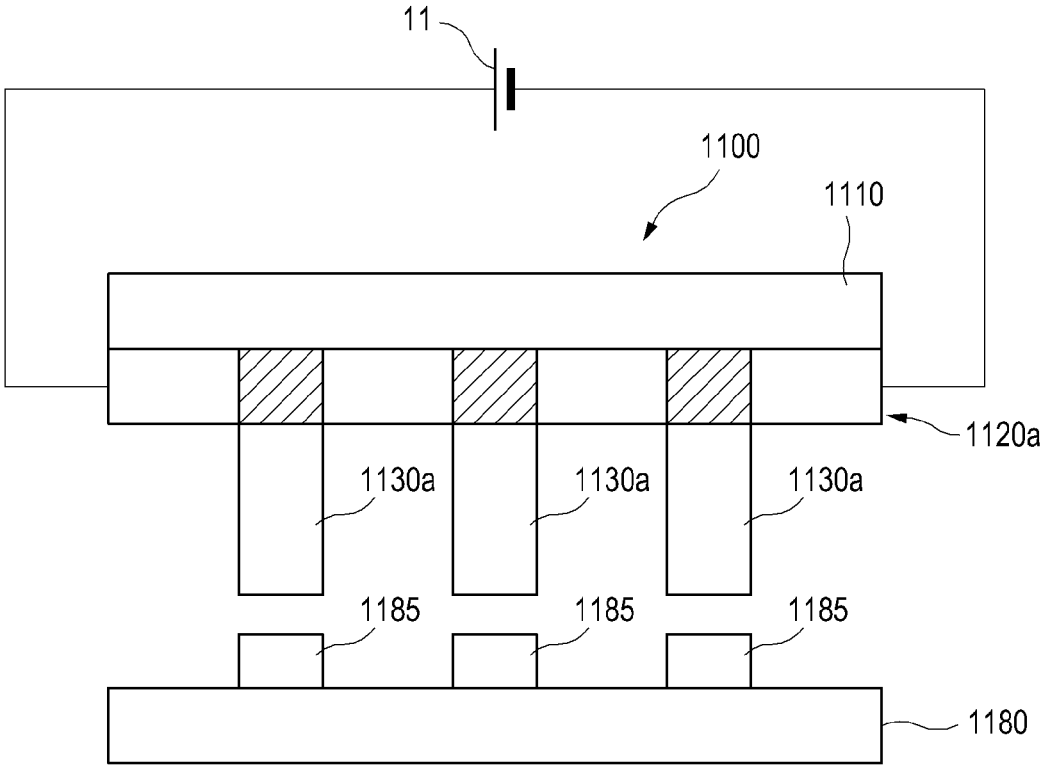
Figure 11D:
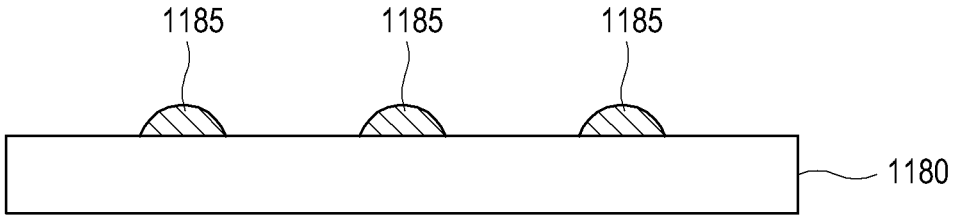
Figure 11E:
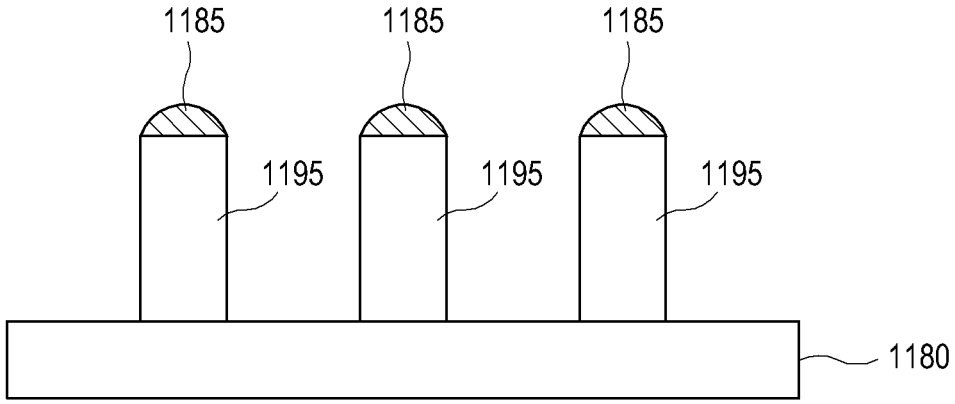

FIG. 10 shows an example flow diagram of an illustrative embodiment of a method for fabricating a nanowire array using a heating device. FIGS. 11A-11E are a series of diagrams illustrating some of the method illustrated in FIG. 10. FIG. 11A is a cross-sectional view of an illustrative embodiment of a heating device connected to an electrical source. FIG. 11B a cross-sectional view of an illustrative embodiment of a substrate and an array of nanostructure catalysts prepared thereon. FIG. 11C a cross-sectional view of an illustrative embodiment of heat-conductive columns of the heating device placed adjacent to the nanostructure catalysts located on the substrate. FIG. 11D a cross-sectional view of an illustrative embodiment of an array of liquid nanostructure catalyst clusters formed on the substrate. FIG. 11E is a cross-sectional view of an illustrative embodiment of an array of nanowires respectively grown under the liquid nanostructure catalyst clusters.

Referring to FIG. 10, a heating device 1100 may be connected with an electrical source 11 to heat at least some of the resistive portions and the at least one heat-conductive column of heating device (block 1010). As shown in FIG. 11A, heating device 1100 includes a substrate 1110, at least one electrically-conductive elongated structure (including electrically-conductive elongated structure 1120*a* having resistive portions 1121*a* and remaining portions 1122*a*), and at least one heat-conductive column (including heat-conductive columns 1130*a* respectively disposed on resistive portions 1121*a*).

As shown in FIG. 11B, at least one nanostructure catalyst (an array of nanostructure catalysts including nanostructure catalysts 1185) may be prepared on a substrate 1180 (block 1020 in FIG. 10). Nanostructure catalysts 1185 may be prepared using any of a variety of techniques known in the art. For example, (a) a resist pattern may be formed on a portion of substrate 1180 to leave the other portions of substrate 1180 uncovered, (b) nanostructure catalysts materials may be deposited on the resist and the uncovered portions of substrate 1180, and (c) selectively removing (e.g., lifting off) the resist and the nanostructure catalysts materials deposited thereon from substrate 1180.

While the embodiment pertaining to FIG. 11B prepares an array of nanostructure catalysts (e.g., nanostructure catalysts 1185) on substrate 1180, in some other embodiments, only a layer of nanostructure catalyst materials covering all or some of substrate 1180 may be used. In one embodiment, a material that may adsorb a vapor of a different material when in liquid phase and from which crystal growth of the adsorbed material can occur may be used as the nanostructure catalyst material. Examples of such nanostructure catalyst material include, but are not limited to, metals (e.g., gold, iron, cobalt, silver, manganese, molybdenum, gallium, aluminum, titanium, and nickel), chlorides, or metal oxides.

As shown in FIGS. 11C and 11D, the heated heat-conductive columns (including heat-conductive columns 1130*a*) may be placed near the at least one nanostructure catalyst (e.g., an array of nanostructure catalysts including nanostructure catalysts 1185 in FIG. 11C) to form therefrom at least one liquid nanostructure catalyst cluster (e.g., an array of liquid nanocatalyst clusters including liquid nanostructure catalyst clusters 1185 in FIG. 11D) (block 1030 in FIG. 10). In some embodiments, nanostructure precursor materials may be added to lower the melting point of nanostructure catalysts 1185 before, during, or after the above heating process is performed. In one embodiment, silicon-containing material may be used as the nanostructure precursor material.

As shown in FIG. 11E, nanostructures (e.g., nanowires 1195) may be grown from the at least one liquid nanostructure catalyst clusters (e.g., liquid nanostructure catalyst clusters 1185) (block 1040 in FIG. 10). In one embodiment, nanowires 1195 may be grown by using various catalytic techniques, which use a catalyst(s) of one material in forming a nanowire of a different material. Examples of such techniques include, but are not limited to, vapor-solid (VS) techniques and vapor-liquid-solid (VLS) techniques. For example, a silicon (Si) containing gas mixture (e.g., a gas mixture including $SiH_4$ and $H_2$) may be introduced to grow nanowires 1195 under nanostructure catalyst clusters 1185. As Si is supplied from the gas mixture, nanostructure catalyst clusters 1185 may become supersaturated with Si and the excess Si may precipitate out of nanostructure catalyst clusters 1185 to form Si nanowires 1195 under nanostructure catalyst clusters 1185. After the growth is complete, nanostructure catalyst clusters 1185 on nanowires 1195 may be removed.

It should be appreciated that the heating device in accordance with the present disclosures may be used in nanostructure fabrication process other than those described in conjunction with FIGS. 8, 9A-9C, 10, and 11A-11E. Other applications include, but are not limited to, polymerization and nanosoldering processes. In the polymerization example, the heating device may be used to selectively heat portions of a polymer film to activate the heat-activated initiators in the heated portions, which initiates polymerization in the heated portions. In the nanosoldering example, the heating device may be used to heat metal particles located between multiple nano-materials to solder the multiple nano-materials with metal particles.

One skilled in the art will appreciate that, for this and other processes and methods disclosed herein, the functions performed in the processes and methods may be implemented in differing order. Furthermore, the outlined steps and operations are only provided as examples, and some of the steps and operations may be optional, combined into fewer steps and operations, or expanded into additional steps and operations without detracting from the essence of the disclosed embodiments.

The present disclosure is not to be limited in terms of the particular embodiments described in this application, which are intended as illustrations of various aspects. Many modifications and variations can be made without departing from its spirit and scope, as will be apparent to those skilled in the art. Functionally equivalent methods and apparatuses within the scope of the disclosure, in addition to those enumerated herein, will be apparent to those skilled in the art from the foregoing descriptions. Such modifications and variations are intended to fall within the scope of the appended claims. The present disclosure is to be limited only by the terms of the appended claims, along with the full scope of equivalents to which such claims are entitled. It is to be understood that this disclosure is not limited to particular methods, reagents, compounds compositions or biological systems, which can, of course, vary. It is also to be understood that the terminology used herein is for the purpose of describing particular embodiments only, and is not intended to be limiting.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (e.g., "a" and/or "an" should be interpreted to mean "at least one" or "one or more"); the same holds true for the use of definite articles used to introduce claim recitations. In addition, even if a specific number of an introduced claim recitation is explicitly recited, those skilled in the art will recognize that such recitation should be interpreted to mean at least the recited number (e.g., the bare recitation of "two recitations," without other modifiers, means at least two recitations, or two or more recitations). Furthermore, in those instances where a convention analogous to "at least one of A, B, and C, etc." is used, in general such a construction is intended in the sense one having skill in the art would understand the convention (e.g., " a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

In addition, where features or aspects of the disclosure are described in terms of Markush groups, those skilled in the art will recognize that the disclosure is also thereby described in terms of any individual member or subgroup of members of the Markush group.

As will be understood by one skilled in the art, for any and all purposes, such as in terms of providing a written description, all ranges disclosed herein also encompass any and all possible subranges and combinations of subranges thereof. Any listed range can be easily recognized as sufficiently describing and enabling the same range being broken down into at least equal halves, thirds, quarters, fifths, tenths, etc. As a non-limiting example, each range discussed herein can be readily broken down into a lower third, middle third, and upper third, etc. As will also be understood by one skilled in the art all language such as "up to," "at least," and the like include the number recited and refer to ranges which can be subsequently broken down into subranges as discussed above. Finally, as will be understood by one skilled in the art, a range includes each individual member. Thus, for example, a group having 1-3 cells refers to groups having 1, 2, or 3 cells. Similarly, a group having 1-5 cells refers to groups having 1, 2, 3, 4, or 5 cells, and so forth.

From the foregoing, it will be appreciated that various embodiments of the present disclosure have been described herein for purposes of illustration, and that various modifications may be made without departing from the scope and spirit of the present disclosure. Accordingly, the various embodiments disclosed herein are not intended to be limiting, with the true scope and spirit being indicated by the following claims.

The invention claimed is:

1. A heating device, comprising:

a nanostructure including:

a substrate;

at least one electrically-conductive elongated structure disposed on the substrate, the at least one electrically-conductive elongated structure including at least one resistive portion having a conductivity lower than that of remaining portions of the at least one electrically-conductive elongated structure; and at least one heat-conductive column directly disposed on the at least one resistive portion of the at least one electrically-conductive elongated structure.

2. The heating device of claim 1, further comprising:

an insulating layer disposed on the substrate so as to cover at least a portion of a surface of the at least one electrically-conductive elongated structure.

3. The heating device of claim 1, wherein the remaining portions of the at least one electrically-conductive elongated structure comprise carbon nano-tube (CNT), graphene, or combinations thereof.

4. The heating device of claim 1, wherein the resistive portion of the at least one electrically-conductive elongated structure comprises metal carbide.

5. The heating device of claim 1, wherein the at least one heat-conductive column comprises a material selected from the group consisting of alumina, other metal oxides, metal carbides, and combinations thereof.

6. The heating device of claim 1, wherein the substrate comprises at least one elastomeric material.

7. The heating device of claim 1, wherein the at least one heat-conductive column extends longitudinally non-parallel relative to the at least one electrically-conductive elongated structure on which the at least one heat-conductive column is disposed.

8. The heating device of claim 1, wherein the resistive portion of the at least one electrically-conductive elongated structure comprises a metal carbide selected from the group consisting of titanium carbide, molybdenum carbide, and combinations thereof.

9. The heating device of claim 1, wherein the heating device is configured as a generally cylindrical heat roller that includes the at least one heat-conductive column formed on lateral outer circumference portions of the generally cylindrical heating device.

10. The heating device of claim 1, wherein the at least one heat-conductive column extends generally perpendicular relative to the at least one electrically-conductive elongated structure on which the at least one heat-conductive column is formed.

11. The heating device of claim 1, wherein the at least one resistive portion in the at least one electrically-conductive elongated structure has a transverse cross-sectional shape and size that is substantially identical to that of the at least one electrically-conductive elongated structure in which it is formed, the at least one resistive portion being entirely contained within outer dimensions of the at least one electrically-conductive elongated structure extending on either side thereof.

12. The heating device of claim 1, wherein the at least one heat-conductive column is formed of a material having a higher thermal conductivity and a lower electrical conductivity than that of the resistive portion on which it is formed.

13. The heating device of claim 1, wherein the at least one resistive portion has a side-length measuring from about 50 nm to about 500 nm.

14. The heating device of claim 1, wherein the at least one heat-conductive column has a width measuring from about 50 nm to about 500 nm.

15. A nanostructure heating device, comprising:

a substrate;

at least one electrically-conductive elongated structure disposed on the substrate, the at least one electrically-conductive elongated structure including at least one resistive portion having a conductivity lower than that of remaining portions of the at least one electrically-conductive elongated structure; and at least one heat-conductive column directly disposed on the at least one resistive portion of the at least one electrically-conductive elongated structure, the at least one heat-conductive column extending longitudinally non-parallel relative to the at least one electrically-conductive elongated structure on which the at least one heat-conductive column is disposed.

16. The device of claim 15, wherein the at least one resistive portion is disposed in the at least one electrically-conductive elongated structure.

17. The device of claim 15, wherein the resistive portion of the at least one electrically-conductive elongated structure comprises a metal carbide.

18. The device of claim 15, wherein the substrate comprises at least one elastomeric material.

19. The device of claim 15, wherein the at least one heat-conductive column comprises a material selected from the group consisting of alumina, other metal oxides, metal carbides, and combinations thereof.

20. A nanostructure heating device, comprising:

a substrate;

at least one electrically-conductive elongated structure disposed on the substrate, the at least one electrically-conductive elongated structure including at least one resistive portion disposed therein, the at least one resistive portion comprising a metal carbide and having a conductivity lower than that of remaining portions of the at least one electrically-conductive elongated structure, the remaining portions of the at least one electrically-conductive elongated structure comprising carbon nanotube (CNT), graphene, or combinations thereof; and at least one heat-conductive column directly disposed on the at least one resistive portion of the at least one electrically-conductive elongated structure, the at least one heat-conductive column extending longitudinally non-parallel relative to the at least one electrically-conductive elongated structure on which the at least one heat-conductive column is disposed.

21. The heating device of claim 1, wherein the at least one resistive portion is located between the substrate and the at least one heat-conductive column.

22. The heating device of claim 1, wherein each at least one elongated structure is configured to be controlled independently.

* * * * *